US006889875B2

(12) United States Patent
Lee et al.

(10) Patent No.: US 6,889,875 B2
(45) Date of Patent: May 10, 2005

(54) TAPER WELL METER DOSE PUMP

(75) Inventors: Charles E. Lee, Union City, CA (US); Jung-Chung Lee, Sunnyvale, CA (US)

(73) Assignee: Cellegy Pharmaceuticals, Inc., So. San Francisco, CA (US)

( * ) Notice: Subject to any disclaimer, the term of this patent is extended or adjusted under 35 U.S.C. 154(b) by 13 days.

(21) Appl. No.: 10/197,627

(22) Filed: Jul. 15, 2002

(65) Prior Publication Data

US 2003/0222105 A1 Dec. 4, 2003

Related U.S. Application Data

(60) Provisional application No. 60/386,014, filed on Jun. 4, 2002.

(51) Int. Cl.[7] ..... B67D 5/42
(52) U.S. Cl. ..... 222/257; 222/321.9
(58) Field of Search ..... 222/256, 257, 222/321.9, 386, 402.2; 141/65

(56) References Cited

U.S. PATENT DOCUMENTS 5,921,438 A * 7/1999 Kobayashi et al. ..... 222/464.2
6,375,045 B1 * 4/2002 Ki ..... 222/256
6,418,978 B2 * 7/2002 Bailly ..... 141/65

* cited by examiner

*Primary Examiner*—Philippe Derakshani
(74) *Attorney, Agent, or Firm*—Townsend and Townsend and Crew LLP; Gerald T. Gray

(57) ABSTRACT

A dispensing device includes a hollow body coupled to a pump mechanism having a dip tube, and to a follower piston. A well provided in the piston is generally larger in diameter than the dip tube to allow fluid in the chamber to flow down into the well as the dip tube enters the well to facilitate fluid removal after a significant portion of the fluid has been removed. In some aspects, the well walls and dip tube end are substantially conical shaped with the well walls substantially parallel to the dip tube end or having a greater angle relative to the axis of the dip tube

29 Claims, 7 Drawing Sheets

TAPER WELL METER DOSE PUMP

CROSS-REFERENCES TO RELATED APPLICATIONS

This application claims the benefit of Provisional Application Ser. No. 60/386,014, filed Jun. 4, 2002, the disclosure of which is incorporated herein by reference.

BACKGROUND OF THE INVENTION

The present invention relates generally to fluid dispensing devices and more particularly to metered-dose pump devices useful for dispensing high-viscosity semi-solid substances.

It is common in the cosmetic industry and the medical industry to provide liquids and pastes in dispensing containers. For example, topical ointments and creams are often provided in dispensing containers configured with pump mechanisms that deliver a specified amount or dose of the fluid in response to user-actuation of the pump mechanism. Examples of such containers and pump mechanisms are shown in U.S. Pat. Nos. 5,217,050, 5,950,880 and 5,961,005, which are each hereby incorporated by reference in its entirety. Typical dispensing devices as shown therein include a substantially tubular hollow container body having a substantially circular cross section fitted with a finger-operable pump mechanism and a follower, or take-up, piston. The finger-operable pump includes a dip tube having an inlet at its end that provides the fluid to a pump chamber for discharge at a dispensing outlet. As fluid product is dispensed, the follower piston slides toward the pump mechanism due to atmospheric pressure acting on the exterior surface of the piston. This action decreases the internal volume of the body by an amount equal to the volume of product discharged. The piston may be fully enclosed by the container body, in which case a vent is typically provided to ensure atmospheric pressure at the external surface of the piston.

FIGS. 1 and 2 illustrate a dispenser configured with a typical follower piston 25 having a well 40 adapted to mate with the receiving end of a dispensing valve, or dip tube 35, when the piston 25 reaches its uppermost position (FIG. 2, associated with a reduced content of product in the body). In general, such a configuration works well for fluid or semi-solid preparations with very low viscosity. However, when more viscous fluids and semi-solid preparations are used, the accuracy of the volume extracted through the inlet into the pump chamber and ultimately dispensed is compromised due to restricted flow of the viscous medium into the piston well around the dip tube. In the particular case of highly viscous material (e.g., greater than about 2,000 cps) the pump mechanism may quit pumping or it may deliver inaccurate volume after a significant portion (e.g., about 70%) of the material has been depleted. In this situation, the gap between the pumping tube and the walls of the piston well is generally too limited to allow slightly viscous to highly viscous material to flow freely into the pumping well. Thus, without sufficient material flowing into the well during actuation of the pump mechanism, the volume delivered may be inaccurate and in some cases the pumping mechanism may not work.

It is therefore desirable to provide dispensing devices that overcome the problems associated with prior devices, and which efficiently dispense fluid, particularly highly viscous substances, after a significant portion of the fluid has been dispensed.

BRIEF SUMMARY OF THE INVENTION

The present invention provides dispensing devices and systems that efficiently dispense fluid, particularly highly viscous substances, after a significant portion of the fluid has been dispensed.

According to the present invention, a dispensing device includes a follower piston coupled within a hollow body and a pump mechanism having a dip tube coupled at the other end of the body and defining a chamber for holding fluid therebetween. A well provided in the piston is generally larger in diameter than the dip tube to allow fluid, and particularly highly viscous fluid, in the chamber to flow down into the well as the dip tube enters the well to facilitate fluid removal after a significant portion of the fluid has already been removed. In some aspects, the well walls and dip tube end are substantially conical shaped with the well walls either substantially parallel to the dip tube end or having a greater angle relative to the axis of the dip tube.

According to an aspect of the present invention, a metered-dose pump device is provided for dispensing doses of a semi-solid substance. The device typically includes a substantially cylindrical body having a central axis and defining a chamber for housing the semi-solid substance, and a dispensing mechanism coupled to one end of the body, the mechanism including a dip tube having an end with an orifice extending into the chamber along the central axis for extracting the semi-solid substance from the chamber. The device also typically includes a piston slidably coupled within the other end of the body, wherein the piston slides with sealable contact within the body, wherein the piston includes a central well which is positioned in line with the central axis, the well having walls with a substantially conical shape and extending outwards from the bottom of the well relative to the central axis, and wherein the bottom of the well is substantially the same size as the orifice of the dip tube. In operation, as the dip tube enters the well, the semi solid substance is able to flow down into the well around the end of the dip tube so as to facilitate extraction of the remaining semi-solid substance after a substantial portion of the semi-solid substance has already been extracted.

According to another aspect of the present invention, a metered-dose pump device is provided for dispensing controlled amounts of a semi-solid substance. The device typically includes a substantially cylindrical body having a central axis and defining a chamber for housing the semi-solid substance, and a dispensing mechanism coupled to one end of the body, the mechanism including a substantially cylindrical dip tube having an end with an orifice extending into the chamber along the central axis for extracting the semi-solid substance from the chamber. The device also typically includes a piston positioned at the other end of the body and within the body, wherein the piston slides with sealable contact within the body, wherein the piston includes a contact surface defining a boundary of the chamber in contact with the semi-solid substance, the surface having a central well which is positioned in line with the central axis, the well having walls extending outwards from the bottom of the well relative to the central axis with a substantially conical shape, and wherein the bottom of the well is substantially the same size as the orifice of the dip tube. In operation, as the semi solid substance is extracted, the piston slides within the body toward the dispensing mechanism so that when a substantial portion of the semi-solid substance has been removed, the dip tube enters the well, and wherein the remaining semi-solid substance flows down into the well proximal the end of the dip tube so as to facilitate extraction of the remaining semi-solid substance.

According to yet another aspect of the present invention, a metered-dose pump device is provided for dispensing a semi-solid substance. The device typically includes a substantially cylindrical body having a central axis and defining a chamber for housing a semi-solid substance, and a dip tube having an end with an orifice extending into the chamber along the central axis. The device also typically includes a pump means, coupled to one end of the body and to the dip tube, for extracting a portion of the semi-solid substance from the chamber through the dip tube, and for providing the extracted semi-solid substance to a user, and a piston, slidably coupled within the other end of the body, wherein the piston slides with sealable contact within the body, wherein the piston includes a central well which is positioned in line with the axis, the well having walls with a substantially conical shape and extending outwards from the bottom of the well relative to the axis, and wherein the bottom of the well is substantially the same size as the orifice of the dip tube. In operation, as the dip tube enters the well, the semi solid substance is able to flow down into the well around the end of the dip tube so as to facilitate extraction of the remaining semi-solid substance after a substantial portion of the semi-solid substance has already been extracted.

Reference to the remaining portions of the specification, including the drawings and claims, will realize other features and advantages of the present invention. Further features and advantages of the present invention, as well as the structure and operation of various embodiments of the present invention, are described in detail below with respect to the accompanying drawings. In the drawings, like reference numbers indicate identical or functionally similar elements.

BRIEF DESCRIPTION OF THE DRAWINGS

FIG. 3 show a side view of a portion of a follower piston according to an embodiment of the present invention;

DETAILED DESCRIPTION OF THE INVENTION

Figure 1:
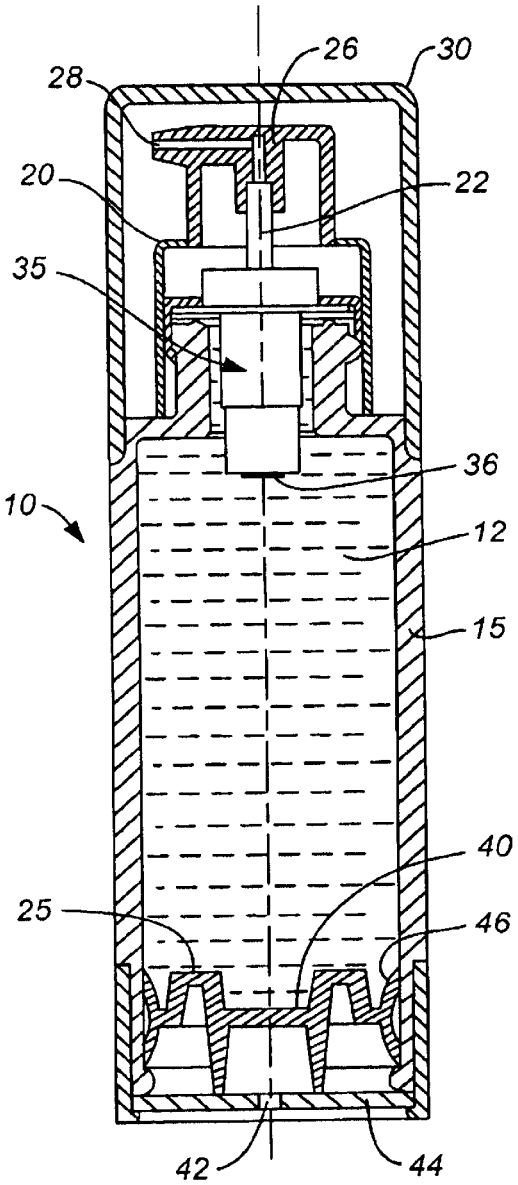
FIG. 1 (PRIOR ART)
FIGS. 1 and 2 illustrate a cross-sectional side view of a prior art dispensing device with the piston at its lowermost and uppermost positions, respectively.
Figure 2:
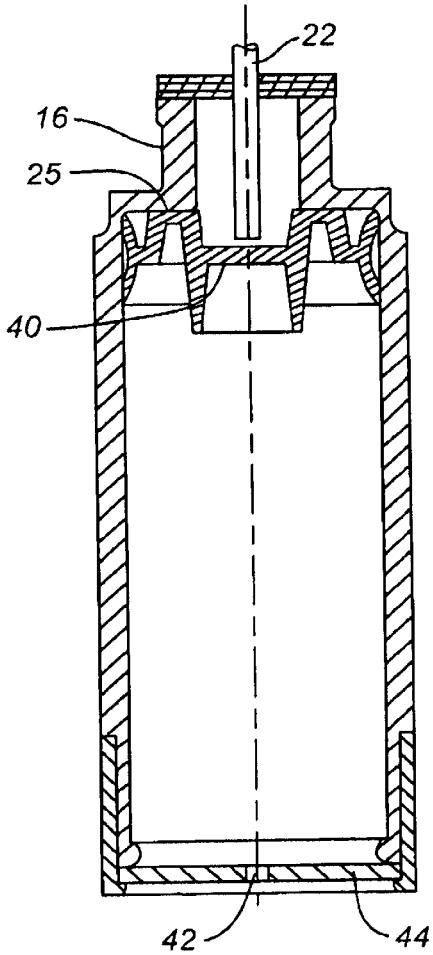
FIG. 2 (PRIOR ART)

As shown in FIGS. 1 and 2, a dispensing device 10 includes a substantially cylindrical hollow body 15 and a pump mechanism 20 and a follower piston 25 defining a chamber 12 therebetween for holding the fluid product to be dispensed. FIGS. 1 and 2 are illustrative of a typical prior art dispensing device, and are used herein to describe general aspects and features of devices of the present invention. Specific implementations, embodiments and modifications according to the present invention will be described below with reference to FIGS. 3–7.

As shown in FIGS. 1 and 2, pump mechanism 20 is adapted to mate with body 15 as is well known, e.g., by snap-fit or screw-fit engagement to top portion 16 of body 15, by glue or other adhesive, or using other suitable mating means. In certain aspects, pump 20 includes an internal pumping mechanism that may be of any appropriate conventional or special non-venting design. Typically, a conventional, non-venting pump, such as the pump illustrated in FIGS. 1 and 2, has an interior chamber (not shown) which has a check valve at the lower end and in which is disposed a pressurizing piston (not shown). The pressurizing piston is arranged to cooperate with a hollow stem 22 which extends out through the top of the body of the pump and which is received within the pump actuator button 26 so as to provide egress to dispensing orifice 28. The stem 22 and the piston within the pump body can move downwardly together in the pump chamber, but the hollow stem 22 can also move for some distance separately relative to the piston so as to establish communication through the hollow stem 22 between the pump chamber and the actuator button 26. One or more springs (not shown in the figures), or other biasing mechanisms, act against the piston and/or stem 22 inside the pump body to bias the piston, stem 22, and actuator button 26 upwardly to an elevated rest position when finger pressure is released. A receiving orifice 36 disposed at the end of the dip tube 35 provides for ingress of the product from chamber 12 into the internal pump chamber. When the actuator button 26 is pressed, product is dispensed from the pump 20 via dispensing orifice 28, and when depressed, product is extracted from chamber 12 into pump 20. In some aspects a check valve, e.g., a ball bearing, may be disposed within dip tube 35 proximal orifice 36 to prevent backflow of product into chamber 12 when actuator button 26 is pressed.

An optional cap or cover 30 may be releasably mounted over pump mechanism 20 as shown. An optional bottom portion 44 is provided, which for embodiments including a vacuum-filled chamber 12 also includes a vent 42 to ensure atmospheric pressure at the external surface (e.g., bottom) of piston 25. A lip seal 46 provides a seal at the contact perimeter between piston 25 and body 15.

U.S. Pat. Nos. 5,217,050, 5,950,880 and 5,961,005, which were previously incorporated by reference, disclose additional aspects of such dispensing devices including manufacturing, filling and using such dispensing devices.

Figure 3:
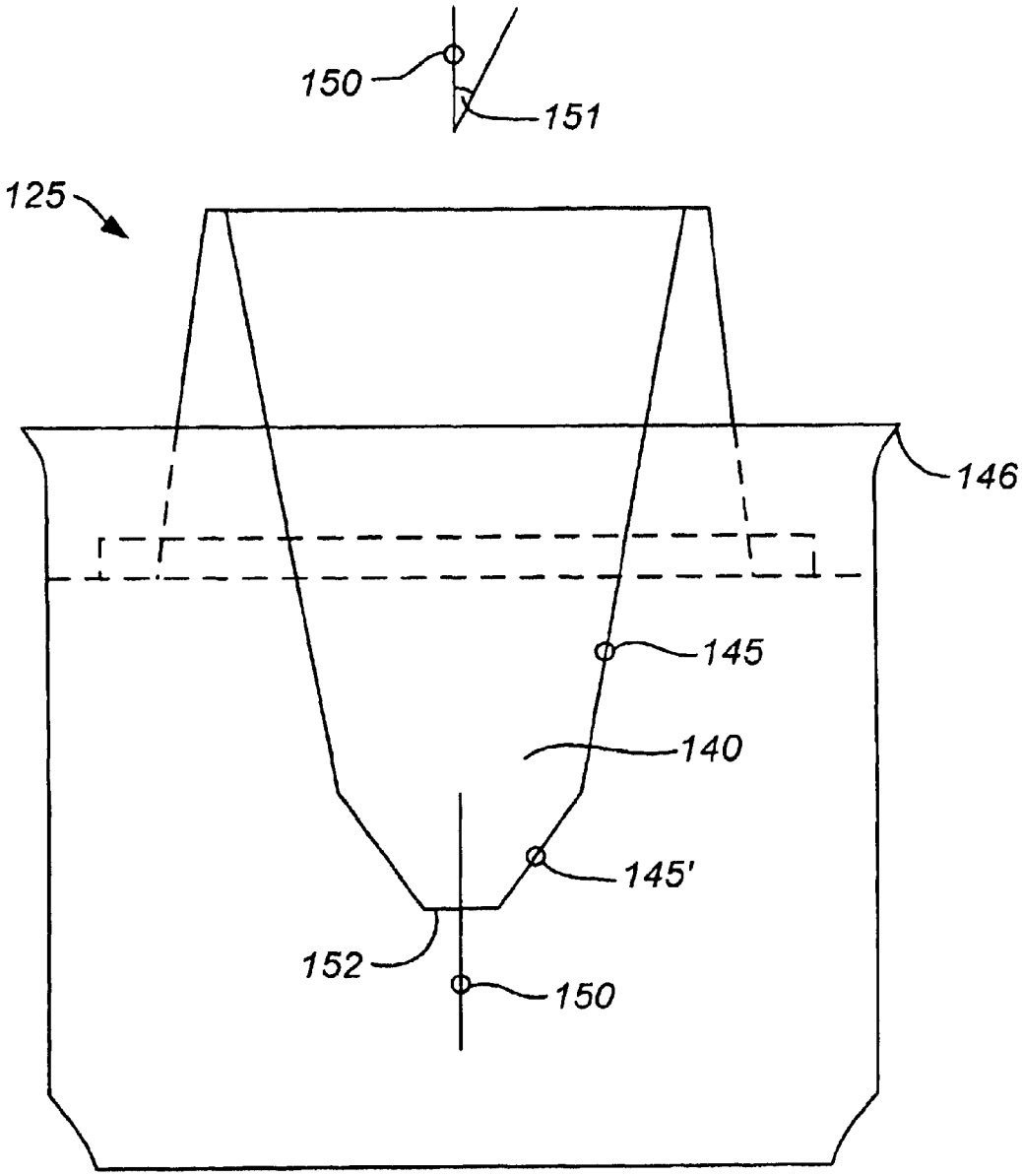
FIG. 3 illustrates a cross section of a portion of a dispensing device according to an embodiment of the present invention.

FIG. 3 show a side view of a follower piston 125 according to an embodiment of the present invention. Piston 125 includes a well 140 defined by well walls 145 and well bottom 152. A lip 146 provides a (slidable) seal with the body of the dispensing device. In one embodiment, as shown, well 140 includes a second wall portion 145' having an angle 151, relative to axis 150, that is greater than the angle formed by first portion 145.

Figure 4:
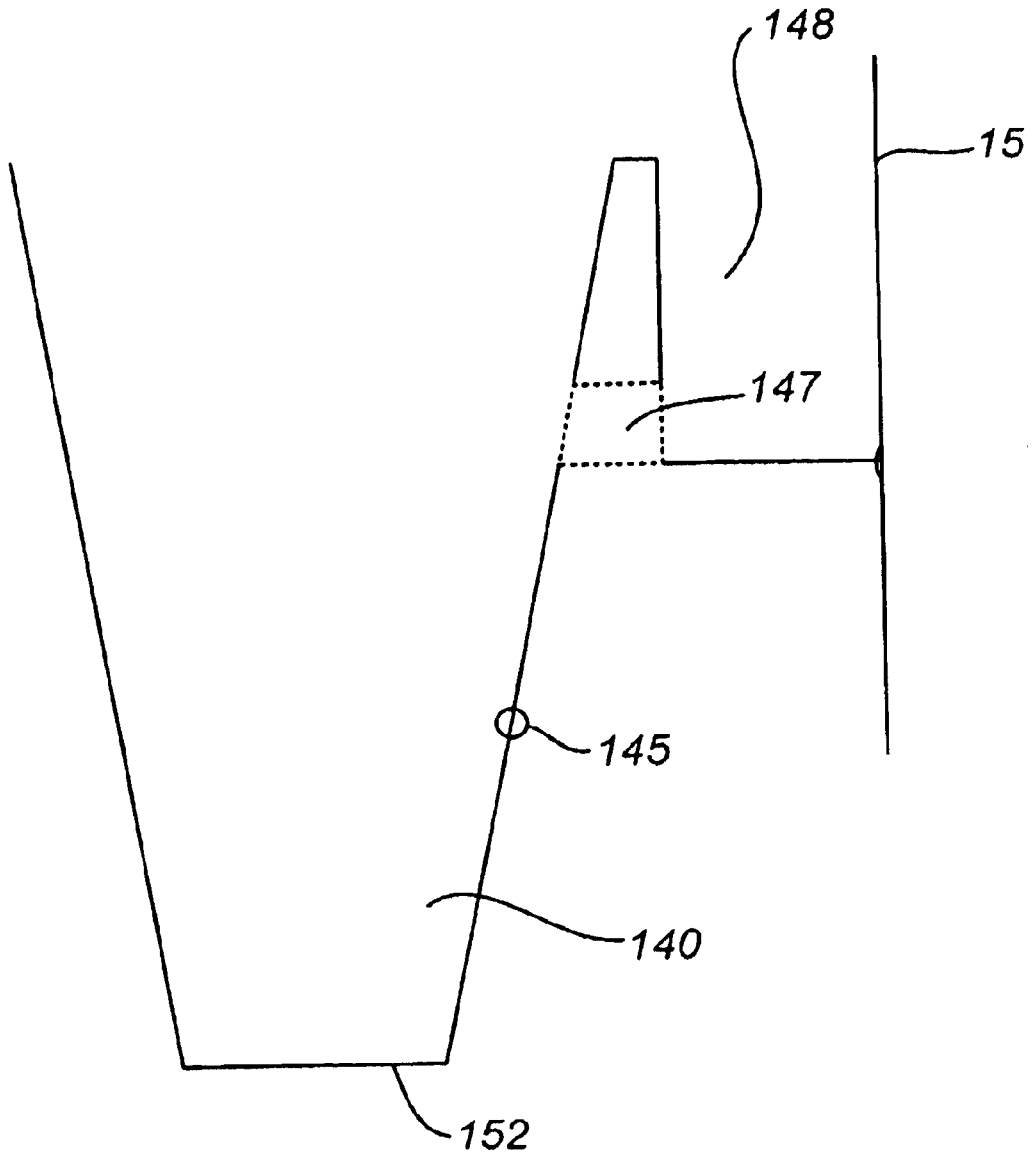
FIG. 4 illustrates another embodiment of a well, including only a first well wall portion according to an embodiment of the present invention.

FIG. 4 illustrates another embodiment of a well 140, including only first well wall portion 145, without a second well wall portion having a different angle relative to axis 150. In this piston configuration embodiment and other embodiments, one or more passageways 147, and/or one or more notches may be cut into or formed in piston 125 so as to provide one or more conduits or openings to facilitate fluid flow into well 140 from space 148 around the periphery of the top of piston 125 as piston 125 approaches pump mechanism 20.

Figure 5:
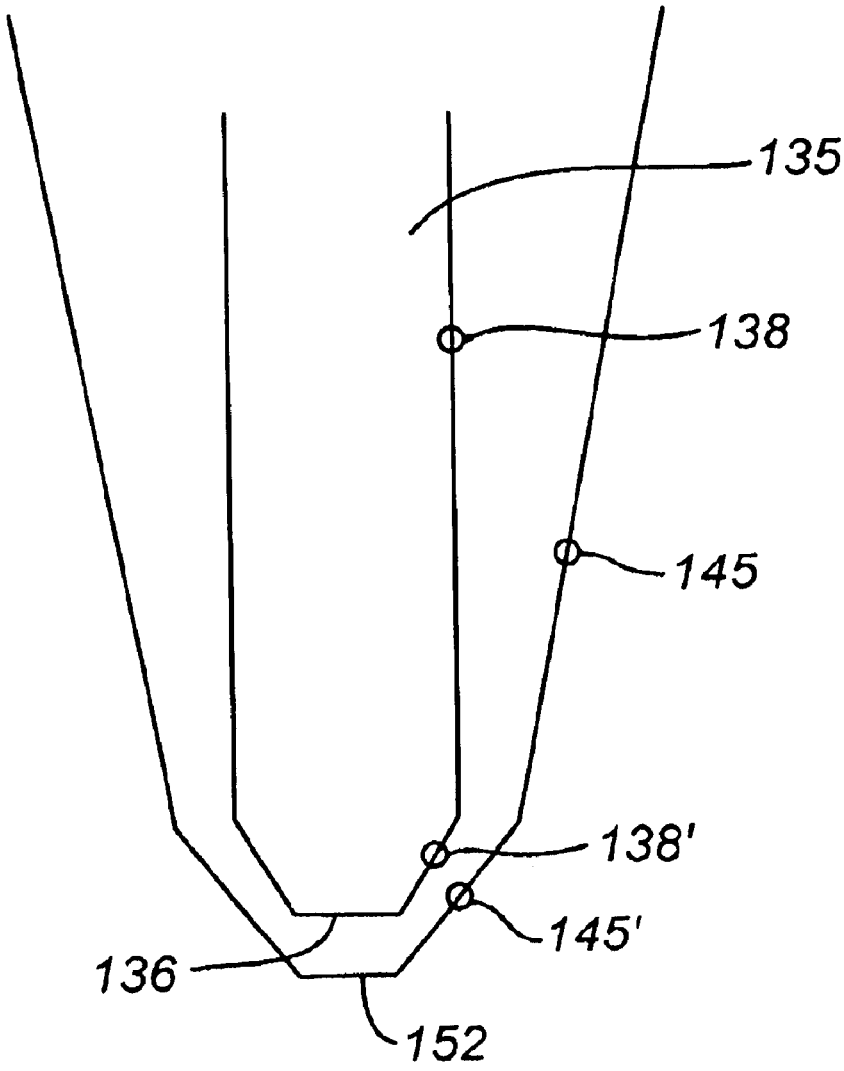
FIG. 5 shows a side view of a portion of a follower piston and a dip tube according to an embodiment of the present invention.

FIG. 5 shows a side view of a portion of the follower piston 125 and a dip tube 135 according to an embodiment of the present invention. In the embodiment as shown in FIG. 5, dip tube 135 includes side walls 138 that are substantially parallel to axis 150 (not shown). Preferably, well 140 and dip tube 135 have substantially circular cross-sections (e.g., when viewed from above), although they may have oval or other cross-section geometries as desired. The increased annular spacing between dip tube wall 138 and well wall 145 advantageously allows fluid, and particularly highly viscous fluid such as fluid having a viscosity greater than about 1,000 cps, and preferably greater than about 2,000 cps, or a non-newtonian rheology, to more freely and efficiently flow therebetween to reach the bottom 152 of well 140 so as to facilitate extraction via orifice 136 of dip tube 135 as tube 135 enters well 140. Second dip tube wall portion 138' is provided in some embodiments, for example, to allow for a larger circumference dip tube and improved fluid flow relative to well wall 145' as dip tube 135 reaches the bottom of well 140.

Figure 6:
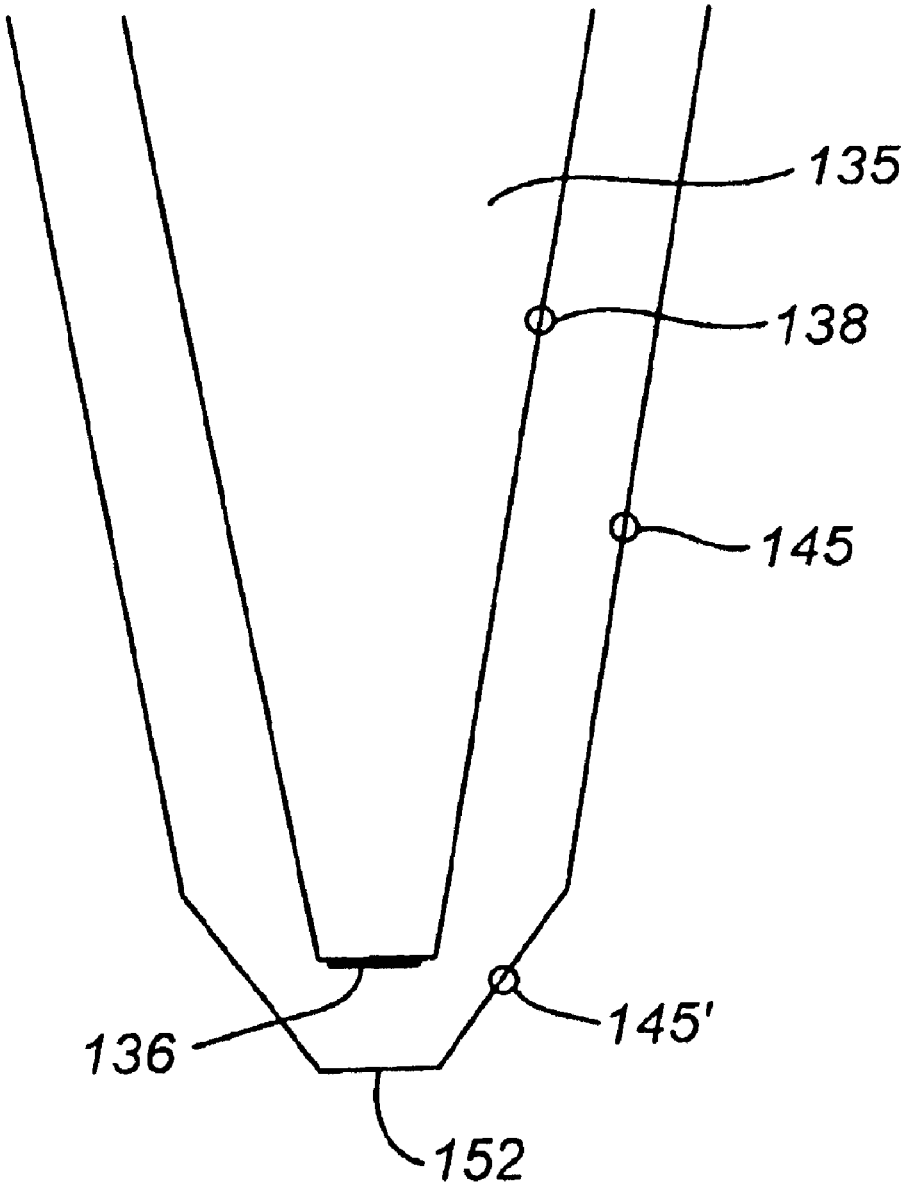
FIG. 6 shows a side view of a portion of a follower piston and a dip tube according to another embodiment of the present invention

FIG. 6 shows a side view of a portion of the follower piston 125 and a dip tube 135 according to another embodiment of the present invention. As shown, dip tube 135 includes walls 138 that are substantially parallel to well walls 145. Dip tube 135 is sized and dimensioned relative to well 140 to provide annular space between dip tube walls 138 and well walls 145 sufficient to allow fluid, and particularly viscous and highly-viscous fluid to efficiently flow therebetween to the bottom 152 of well 140 as dip tube 135 enters well 140. Again, well 140 and dip tube 135 preferably have substantially circular cross-sections (e.g., when viewed from above) such as to form conical-shaped structures, although they may have oval or other cross-section geometries as desired In the above and later embodiments, the angle 151 between axis 150 and well walls 145 and/or tube walls 138 is preferably not greater than 30 degrees, but may be greater such as 40 degrees, 45 degrees or more. Additionally, the relative angle between the well walls 145 and axis 150 is preferably greater than or equal to the relative angle between the dip tube walls 138 and axis 150.

Figure 7:
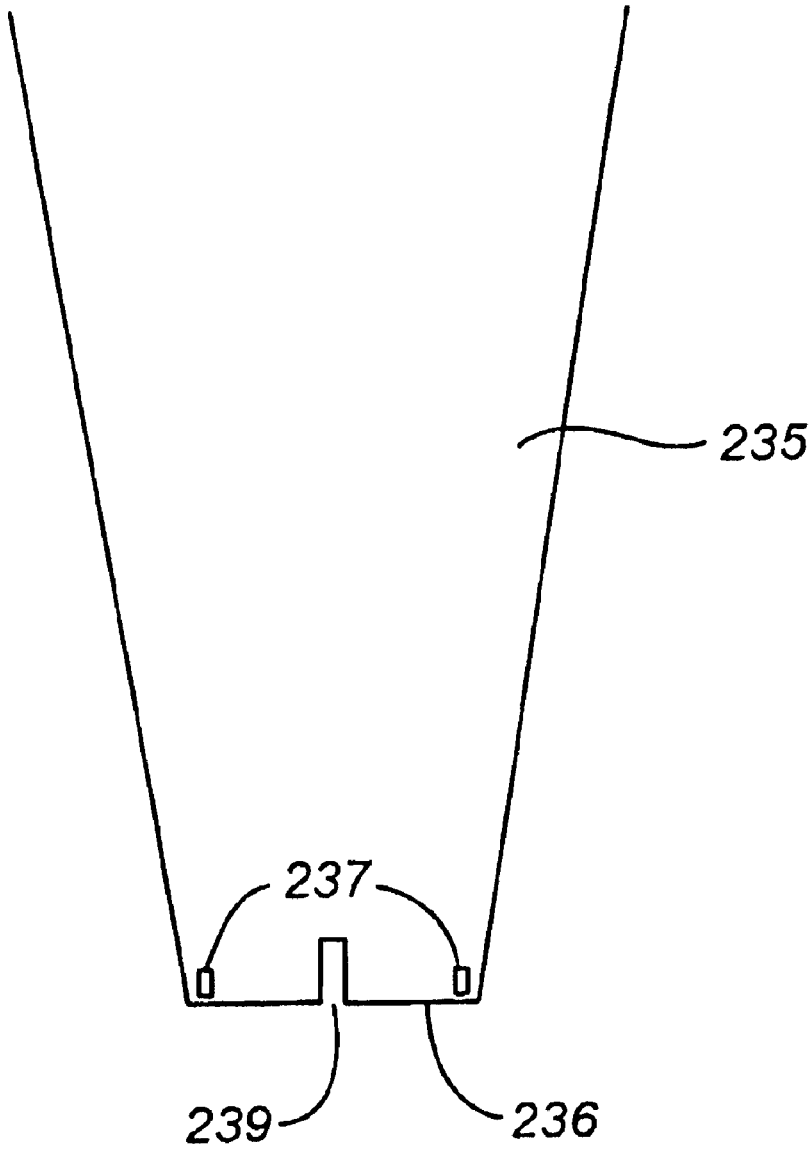
FIG. 7 illustrates another embodiment of the dip tube of FIG. 6.

FIG. 7 illustrates additional features and embodiments of a dip tube similar to dip tube 135 of FIG. 6. As shown, in one embodiment, dip tube 235 includes one or more perforations 237 positioned proximal the bottom of the dip tube to facilitate extraction of fluid into the internal pump chamber (not shown). Alternately, or additionally, one or more slotted openings 239 are provided to facilitate fluid extraction. It should be understood that the number and dimensions of the perforations and/or slotted openings can be varied as desired for the particular application/fluid medium. It should also be appreciated that perforations and/or slotted openings are applicable to other dip tube configurations including, for example, the dip tube configuration as shown in FIG. 5, wherein such openings and/or perforations would preferably be included in walls 138'.

It should be appreciated that the dip tube configurations as shown in FIGS. 5 and 6 and used with the well configuration of FIG. 3, could also be used with the well configuration shown in FIG. 4, wherein the dip tube is preferably geometrically configured and sized relative to the well walls to provide improved fluid flow as taught herein. Additionally, in vacuum sealed embodiments, the chamber 12 may be filled with fluid either under vacuum, or under atmospheric pressure and then vacuum pressured.

Figure 8A:
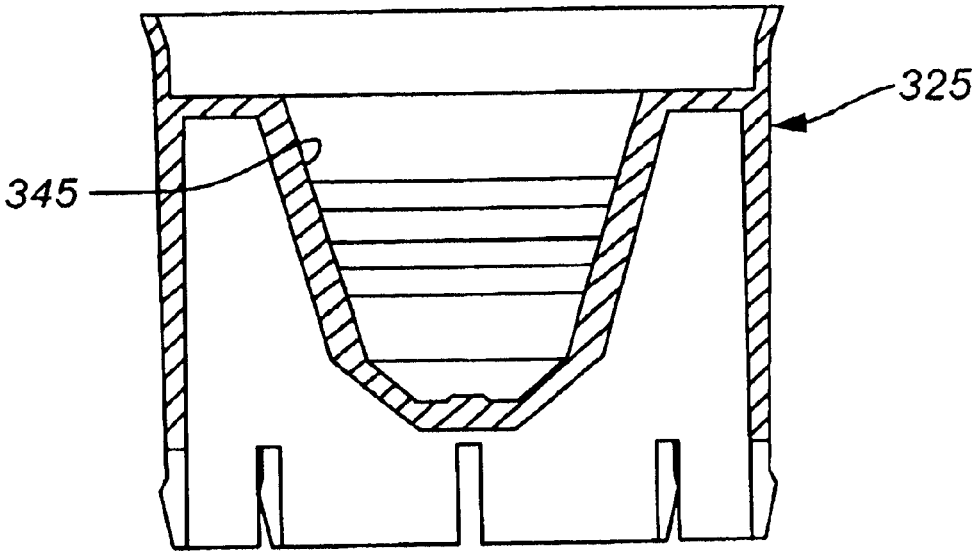
FIGS. 8*a* and 8*b* illustrate a side view and an isometric view, respectively, of a follower piston according to another embodiment of the present invention.
Figure 8B:
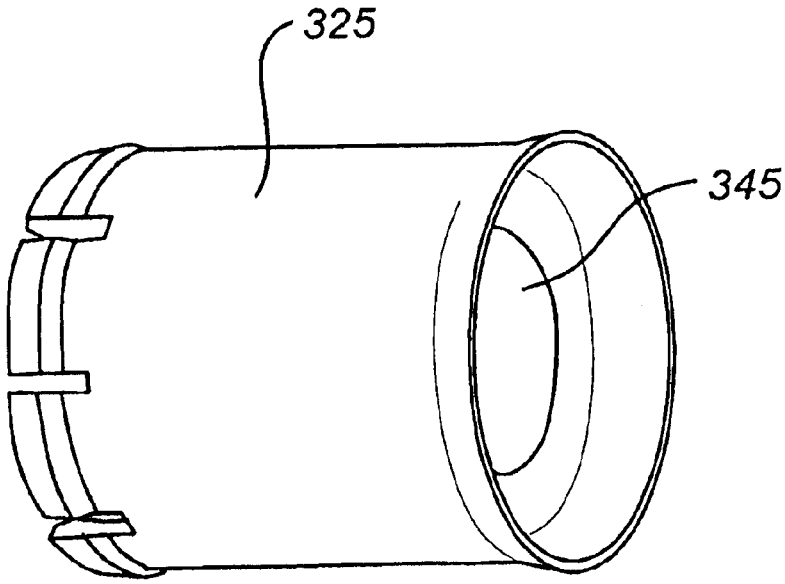

FIGS. 8*a* and 8*b* illustrate a side view and an isometric view, respectively, of a follower piston 325 according to another embodiment of the present invention. Follower piston 325 is similar in many respects to follower piston 125 of FIG. 3. In piston 325, the walls 345, however, do not extend above the main body as shown, whereas walls 145 of piston 125 extend above the main body, e.g., above the circumference defined by lip 146. It should be appreciated that other piston configurations may be implemented within the scope of the present invention.

While the invention has been described by way of example and in terms of the specific embodiments, it is to be understood that the invention is not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A metered-dose pump device for dispensing doses of a semi-solid substance, the device comprising:

a substantially cylindrical body having a central axis and defining a chamber for housing the semi-solid substance;

a dispensing mechanism coupled to one end of the body, the mechanism including a dip tube having an end with an orifice extending into the chamber along said central axis for extracting the semi-solid substance from the chamber; and a piston slidably coupled within the other end of the body, wherein the piston slides with sealable contact within said body, wherein said piston includes a central well which is positioned in line with said axis, said well having walls with a substantially conical shape and extending outwards from the bottom of the well relative to said axis, and wherein the bottom of the well is substantially the same size as the orifice of the dip tube, wherein as the dip tube enters the well the semi solid substance is able to flow down into the well around the end of the dip tube so as to facilitate extraction of the remaining semi-solid substance after a substantial portion of the semi-solid substance has already been extracted.

2. The device of claim 1, wherein the end of the dip tube has a conical shape.

3. The device of claim 2, wherein the walls of the piston well are substantially parallel to the conical-shaped end of the dip tube.

4. The device of claim 1, wherein the walls of the piston well form an angle of not greater than 30 degrees relative to the central axis.

5. The device of claim 1, wherein the end of the dip tube includes one or more perforations proximal the orifice.

6. The device of claim 1, wherein the end of the dip tube includes one or more slotted openings proximal the orifice.

7. The device of claim 1, wherein the semi-solid substance has a viscosity of greater than 2,000 cps.

8. The device of claim 1, wherein the semi-solid substance has a non-newtonian rheology.

9. The device of claim 1, wherein the dispensing mechanism seals the chamber such as to prevent the ingress of air into the chamber as the semi-solid substance is being extracted through the dip tube.

10. The device of claim 1, wherein the chamber is filled with the semi-solid substance under vacuum.

11. A metered-dose pump device for dispensing controlled amounts of a semi-solid substance, the device comprising:

a substantially cylindrical body having a central axis and defining a chamber for housing the semi-solid substance;

a dispensing mechanism coupled to one end of the body, the mechanism including a substantially cylindrical dip tube having an end with an orifice extending into the chamber along said central axis for extracting the semi-solid substance from the chamber; and a piston positioned at the other end of the body and within the body, wherein the piston slides with sealable contact within said body, wherein said piston includes a contact surface defining a boundary of said chamber in contact with the semi-solid substance, said surface having a central well which is positioned in line with said axis, said well having walls extending outwards from the bottom of the well relative to said axis with a substantially conical shape, and wherein the bottom of the well is substantially the same size as the orifice of the dip tube, wherein as the semi solid substance is extracted, the piston slides within the body toward the dispensing mechanism so that when a substantial portion of the semi-solid substance has been removed, the dip tube enters the well, and wherein the remaining semi-solid substance flows down into the well proximal the end of the dip tube so as to facilitate extraction of the remaining semi-solid substance.

12. The device of claim 11, wherein the end of the dip tube has a conical shape.

13. The device of claim 12, wherein the walls of the piston well are substantially parallel to the conical-shaped end of the dip tube.

14. The device of claim 11, wherein the walls of the piston well from an angle of not greater than 30 degrees relative to the central axis.

15. The device of claim 11, wherein the end of the dip tube includes one or more perforations proximal the orifice.

16. The device of claim 11, wherein the end of the dip tube includes one or more slotted openings proximal the orifice.

17. The device of claim 11, wherein the semi-solid substance has a viscosity of greater than 2,000 cps.

18. The device of claim 11, wherein the semi-solid substance has a non-newtonian rheology.

19. The device of claim 11, wherein the dispensing mechanism seal the chamber such as to prevent the ingress of air into the chamber as the semi-solid substance is being extracted through the dip tube.

20. The device of claim 11, wherein the chamber is filled with the semi-solid substance under vacuum.

21. A metered-dose pump device for dispensing a semi-solid substance, the device comprising:

a substantially cylindrical body having a central axis and defining a chamber for housing a semi-solid substance;

a dip tube having an end with an orifice extending into the chamber along said central axis;

pump means, coupled to one end of the body and to said dip tube, for extracting a portion of the semi-solid substance from the chamber through said dip tube, and for providing the extracted semi-solid substance to a user; and a piston slidably coupled within the other end of the body, wherein the piston slides with sealable contact within said body, wherein said piston includes a central well which is positioned in line with said axis, said well having walls with a substantially conical shape and extending outwards from the bottom of the well relative to said axis, and wherein the bottom of the well is substantially the same size as the orifice of the dip tube, wherein as the dip tube enters the well the semi solid substance is able to flow down into the well around the end of the dip tube so as to facilitate extraction of the remaining semi-solid substance after a substantial portion of the semi-solid substance has already been extracted.

22. The device of claim 21, wherein the end of the dip tube has a conical shape.

23. The device of claim 22, wherein the walls of the piston well are substantially parallel to the conical-shaped end of the dip tube.

24. The device of claim 21, wherein the walls of the piston well form an angle of not greater than 30 degrees relative to the central axis.

25. The device of claim 21, wherein the end of the dip tube includes one or more perforations proximal the orifice.

26. The device of claim 21, wherein the end of the dip tube includes one or more slotted openings proximal the orifice.

27. The device of claim 21, wherein the semi-solid substance has a viscosity of greater than 2,000 cps.

28. The device of claim 21, wherein the pump means seals the chamber such as to prevent the ingress of air into the chamber as the semi-solid substance is being extracted through the dip tube.

29. The device of claim 11, wherein the chamber is filled with the semi-solid substance under vacuum.

* * * * *